United States Patent [19]

Bogaert

[11] 3,977,134

[45] Aug. 31, 1976

[54] VENT CLOSURE ARRANGEMENT

[76] Inventor: Pierre Emmanuel Eugene Jean Bogaert, Chalet du Dijk, 20, Wemmel, Belgium

[22] Filed: Feb. 28, 1975

[21] Appl. No.: 554,206

[30] Foreign Application Priority Data

Mar. 14, 1974 Belgium ..... 142001

[52] U.S. Cl. ..... 52/1; 49/4; 49/7; 49/379

[51] Int. Cl.[2] ..... E05F 15/20

[58] Field of Search ..... 52/200, 1, 66; 49/4, 49/7, 8, 279, 379

[56] References Cited

UNITED STATES PATENTS

| | | | |
|---|---|---|---|
| 730,373 | 6/1903 | Izatt | 49/379 |
| 1,006,374 | 10/1911 | Erb | 52/66 |
| 1,137,473 | 4/1915 | Ford | 52/66 |
| 1,239,421 | 4/1917 | Metzger | 52/1 |
| 1,689,131 | 10/1928 | Goodwin | 52/1 |
| 3,189,142 | 6/1965 | Carlson | 49/7 |
| 3,577,691 | 5/1971 | Persson | 52/200 |
| 3,589,065 | 6/1971 | Watson | 49/7 |
| 3,815,299 | 6/1974 | Sorensen | 52/66 |

*Primary Examiner*—Ernest R. Purser
*Assistant Examiner*—Henry Raduazo
*Attorney, Agent, or Firm*—Kurt Kelman

[57] ABSTRACT

A roof vent for releasing smoke and heat from a building in the case of a fire is provided with a cover mounted on two track members for movement in the common direction of elongation of the track members which define therebetween an opening through the roof. The cover is permanently biased away from the position in which it closes the roof opening, but is normally retained in its closing position by a detent device which may be inactivated by temperature sensitive apparatus in the case of a fire. The operating elements of the vent are concealed from view and protected from the elements by being arranged under the cover member.

8 Claims, 7 Drawing Figures

VENT CLOSURE ARRANGEMENT

Figure 1:
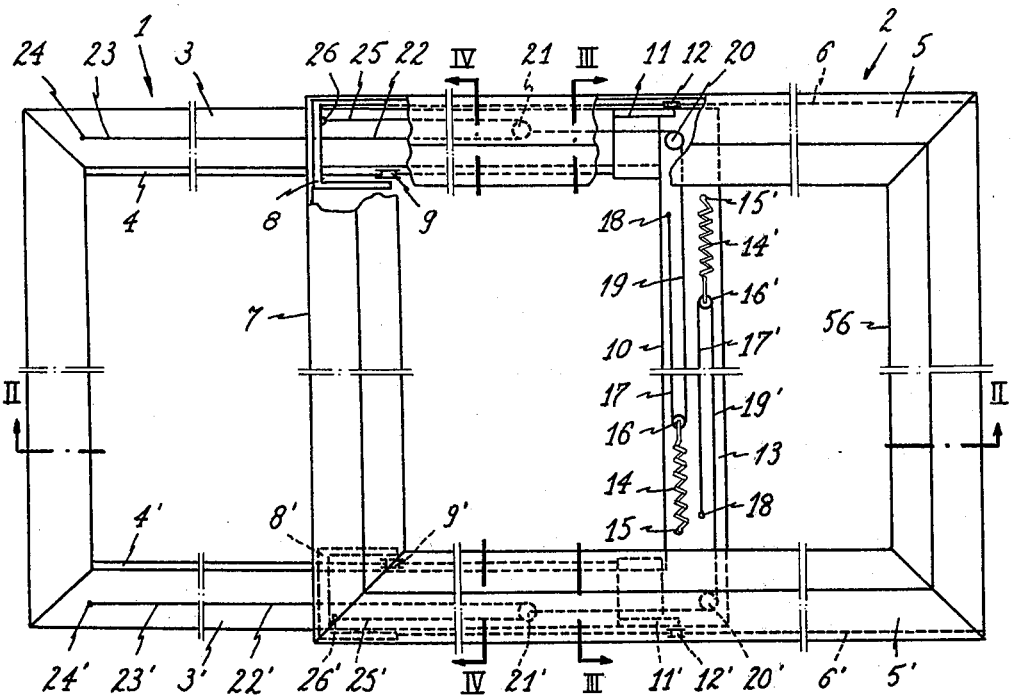

This invention relates to large vents in roofs or other surfaces of a building which open automatically when the temperature rises above a set value, as in the case of a fire in the building, to release smoke and heat which would interfere with the work of fire-fighters, and particularly to a closing arrangement for such vents.

Building codes in many cities require that a significant portion of a flat building roof be occupied by vents, the specific values varying between one percent and 5 percent. Because of their great expanse, the automatically operated covers over the vents have been used as skylights, and it has been found useful to provide them with manual operating devices so that they may admit fresh air or release stale air. Typically, each vent and the associated cover have major surfaces of 3 square meters or more, vent covers of 24 square meters not being uncommon.

The known vent covers are secured to the roof by hinges, and are automatically pivoted to the open position in the event of fire by springs, counter-weights, or pressure-fluid actuated motors. Because of the size and weight of the cover, which may further be loaded with a layer of snow, the operating mechanisms of the known automatic vent cover arrangements are bulky, heavy, and expensive to build, to install, to maintain, and to operate. The open vent covers present a large surface area to the wind, and must be built to withstand substantial wind pressure.

It is a primary object of this invention to avoid the shortcomings of the known vent arrangements, and particularly to provide an arrangement which requires only small forces for opening the vent and, for holding the cover in the open condition. Another object is the provision of a vent arrangement whose operating mechanism can be made small enough that it does not require modification of a roof structure beyond the necessary making of a vent opening, is practically completely concealed from view, and does not significantly obstruct the flow path of smoke or hot air through the vent opening.

In one of its more specific aspects, the invention provides two track members, normally mounted in fixed positions on a roof. The track members are elongated in a common direction in transversely spaced relationship and define an opening therebetween which may be the roof opening or may be aligned with the roof opening. A cover member is mounted on the track members for translatory movement in the direction of track member elongation toward and away from its closing position in which it closes the afore-mentioned opening between the track members.

Means are provided for permanently biasing the cover member to move away from the closing position, but a detent device normally retains the cover member in the closing position against the force of the biasing means. A temperature-responsive inactivating mechanism inactivates the detent device in response to a temperature which may be selected to suit specific conditions. The biasing means, detent device, and inactivating mechanism are offset from the cover member in a direction toward the track members, and thus concealed from view and protected against the elements of the atmosphere.

Figure 2:
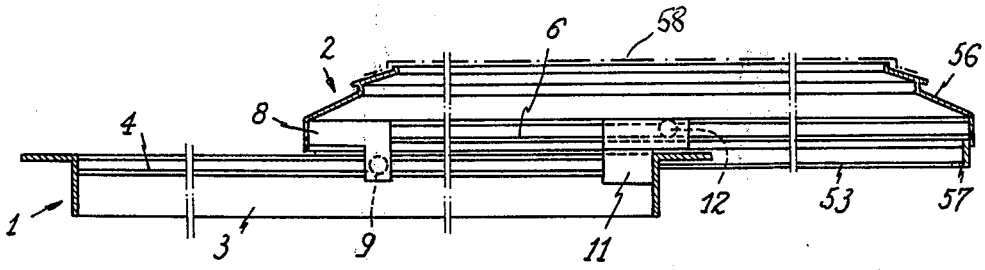
Figure 3:
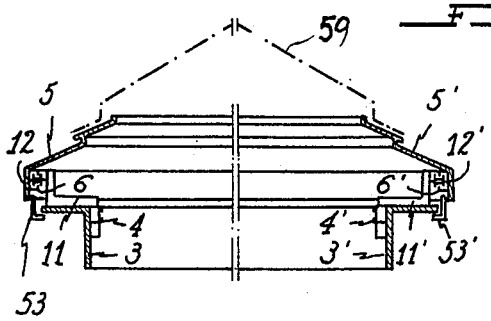
Figure 4:
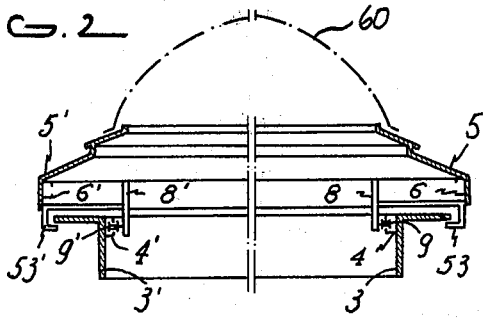
Figure 5:
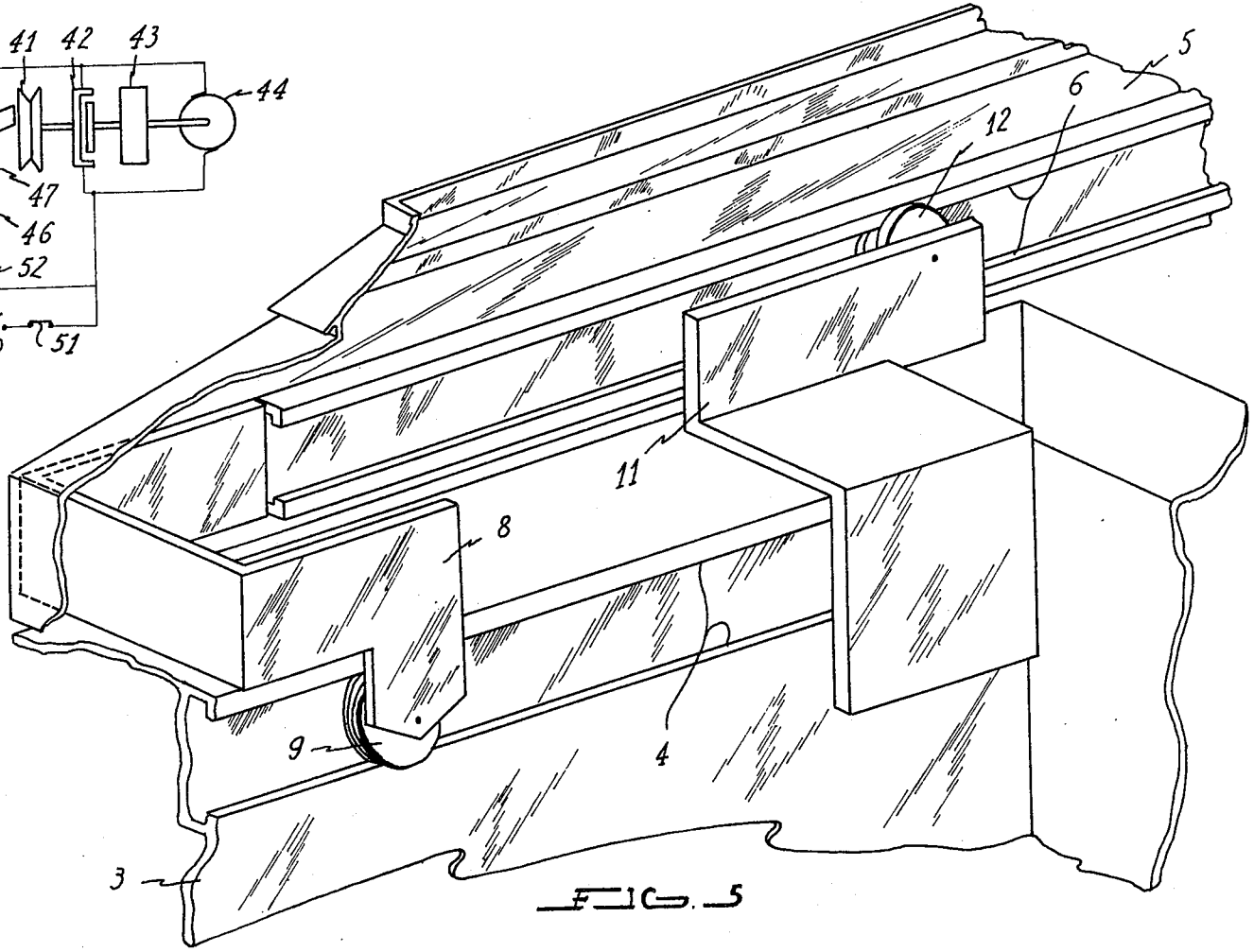
Figure 6:
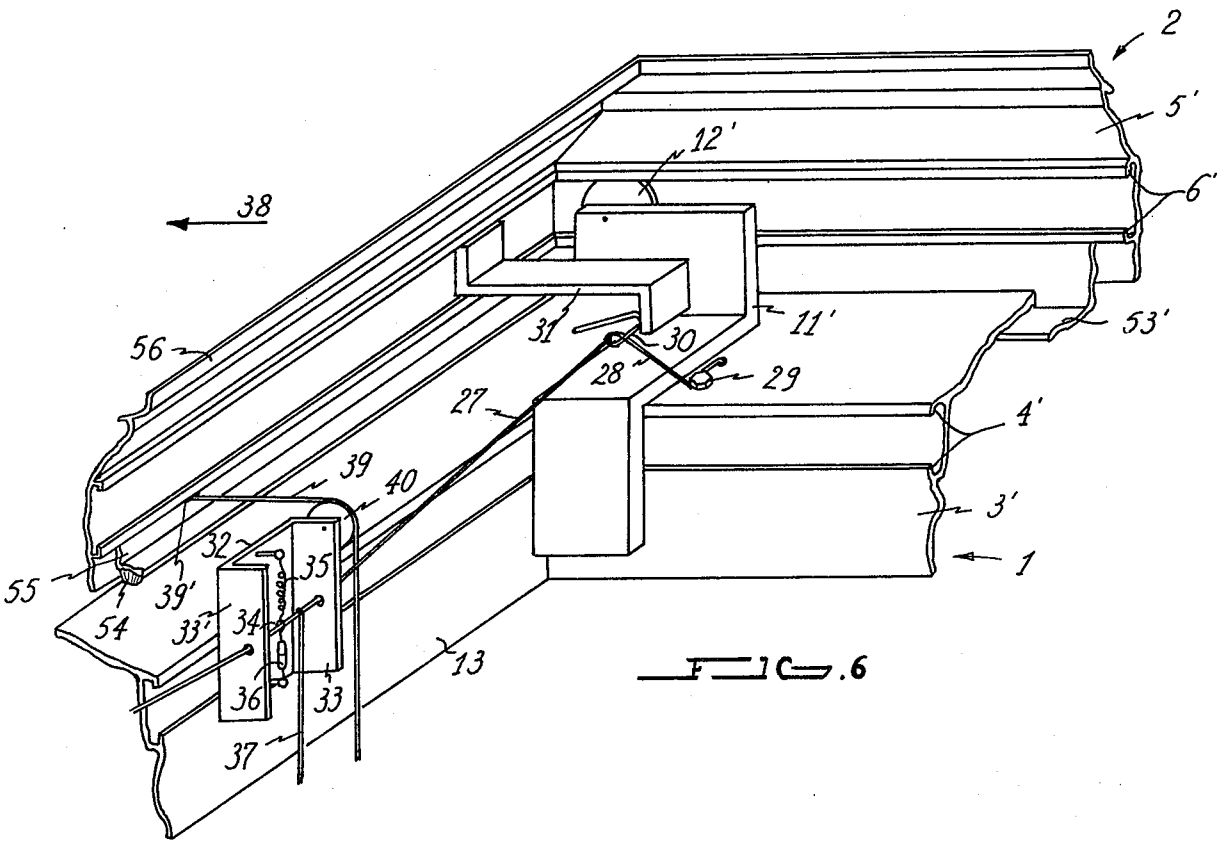

Other features, additional objects, and many of the attendant advantages of this invention will readily be appreciated as the same becomes better understood by reference to the following detailed description of preferred embodiments, when considered in connection with the appended drawing in which:

FIG. 1 is a top plan view of a vent closure arrangement of the invention, portions of the structure being broken away to reveal normally obscured elements;

FIGS. 2, 3, and 4 show the apparatus of FIG. 1 in section on the lines II—II, III—III, and IV—IV respectively;

FIGS. 5 and 6 are fragmentary perspective views of the apparatus of FIG. 1; and

Figure 7:
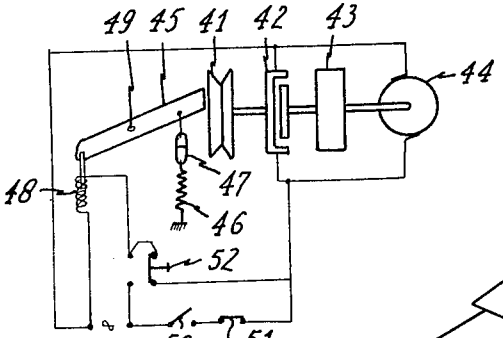

FIG. 7 diagrammatically illustrates a modification of the device shown in FIG. 6.

Referring now to the drawing in detail, and initially to FIG. 1, there is shown a rectangular, elongated frame 1, normally fixedly mounted on a flat roof top about an opening in the roof which communicates with the central opening in the frame 1. Another frame 2 of approximately the same dimensions is superimposed on the stationary frame 1. The longitudinal members 3,3' of the frame 1 are steel or aluminum angles, as is evident from joint consideration of FIGS. 1–4, and constitute roller tracks equipped with channels 4,4'. Similarly, the longitudinal members 5,5' of the movable frame 2 are equipped with channels 6,6' to provide a second pair of roller tracks. The longitudinal members 5,5' of the movable frame 2 are connected by transverse end members 7,56 of the frame, and the frame 1 has corresponding transverse members 13.

Brackets 8,8' on the movable transverse frame member 7 carry rollers 9,9' which are guided in the channels 4,4' on the stationary track members 3,3'. Similarly, one of the stationary, transverse frame members 13 carries brackets 11,11' for rollers 12,12' guided in the channels 6,6' of the movable frame 2. The frame 2 thus can travel on the rollers from the position shown in FIG. 1 toward the left until it is vertically aligned with the frame 1 in a closing position in which a sheet 58 of light-permeable glass or plastic mounted on the frame 2 closes the opening in the frame 1, such a sheet having been omitted from FIG. 1 for the sake of clarity, and indicated in FIG. 2 in chain dotted lines. It may be replaced in a known manner by a gabled, light-permeable dome 59 or an arcuate plastic dome 60, as is indicated by chain-dotted lines in FIGS. 3 and 4.

The movable frame 2 and the light-permeable sheet or dome 58, 59, 60 jointly constitute a cover which may also move from the position shown in FIG. 1 toward the right to the limit of roller travel on the associated tracks. The cover is biased by helical tension springs 14,14' whose ends 15,15' are fixedly fastened to the top surface 10 of stationary transverse frame member 13 while the other spring ends carry pulleys 16,16'. Respective first ends 18,18' of cables, chains or other tension members 17,17' are attached to the top surface 10, the tension members are trained over the pulleys 16,16' to form two parallel strands 19,19', and over guide pulleys 20,20' which deflect them from a transverse direction into the common direction of elongation of the frames 1,2, along the stationary longitudinal frame members 3,3'. The second ends of the tension members 19,19' carry pulleys 21,21'. Further tension members 22,22' have ends 24,24' attached to portions of the stationary frame 1 remote from pulley 20,20' and the tension members 22,22' are trained over the pulleys 21,21' so as to form parallel strands 23,25, 23',25', the other ends 26,26' of the tension members 22,22' being attached to the transverse frame member 7 movable-frame 2. The springs 14,14′ thus bias the vent cover to move away from the position in which it closes the opening defined between the track members 3,3′ and transverse members 13 of frame 1.

Such movement is normally prevented by a detent arrangement best seen in FIG. 6. One end of a spring wire 28 is attached to the track member 3′ adjacent bracket 11′ by a screw 29. The central portion of the wire is bent to form a loop, and the other end forms a generally V-shaped latch 30 engaged by a metal strap 31 on transverse frame member 56 of movable frame 2 in such a manner that the frame 2 cannot move under the spring bias in the direction indicated by an arrow 38 in FIG. 6. The detent structure described so far is duplicated on the other longitudinal side of the frames 1,2 in a manner not specifically illustrated.

The two latches 30 may be retracted by a cable or string 27 whose ends are fastened to the loops of the latches 30, and which passes through aligned openings in the two flanges 33,33′ of an upright U-channel 32 fixedly fastened to stationary transverse frame member 13. Between the flanges 33,33′, the cable or string 27 passes through a loop 34 of a wire which connects respective ends of a helical tension spring 35 and of a fusable link 36, the other ends being fastened to the web of the channel 32. Another rope 37 is attached to the rope or cable 27 between the flanges 33,33′ and depends through the opening in the non-illustrated roof to the top floor of the building. One end 39′ of a further rope 39 is attached to the movable transverse frame member 56, is trained over a guide pulley 40 on the channel 32 and hangs down to the non-illustrated top floor of the building.

The link 36 consists of a low-melting alloy chosen to lose its strength at the temperature at which the vent cover is desired to open automatically. When the link 36 softens or melts, the spring 35 pulls the rope or cable 27 upward between the flanges 33,33′, thereby retracting both latches 30 and permitting the springs 14,14′ to move the vent cover to its fully open position, not shown. However, the latches may also be inactivated manually by pulling the rope 37. In either case, the vent cover may be returned to its closing position by pulling the rope 39. When the straps 31 strike the obliquely inclined cam faces of the latches 30 during the return movement, they deflect the latches until the illustrated closing position is reached, and the latches drop into position behind the straps 31 as shown in FIG. 6.

The detent arrangement and its inactivating mechanism and other associated devices shown in FIG. 6 may be replaced by an electromechanical device shown in FIG. 7 which requires neither the latches 30, nor the ropes 27,37, and uses a fusible link and a spring in a different manner to control all cover movements by means of the rope 39, not itself shown in FIG. 7.

The free end of the rope 39, not seen in FIG. 6 is wound in several turns on a pulley 41 which is mounted on the output shaft of an electromagnetic clutch 42. The input shaft of the clutch is connected by a speed reducing transmission 43 to the output shaft of an electric motor 44. A brake lever 45 normally engages the pulley 41 under the biasing force of a helical tension spring 46 to which the lever is connected by a fusible link 47. A solenoid 48, when energized, pivots the brake lever 45 on a shaft 49 in a direction to release the pulley 41. The devices illustrated in FIG. 7 are mounted below the vent cover on the stationary frame 1 or on adjacent portions of the roof structure.

The electric circuit of the device shown in FIG. 7 includes a source of alternating current having one terminal connected by a return line to respective terminals of the solenoid 48, the clutch 42, and the motor 44. The other terminal is connected to the motor 44 and the clutch 42 through a manually operated actuating switch 50 and a normally closed limit switch 51 arranged in series. A single-pole, double-throw push button switch 52 normally connects the solenoid with the AC source either through the switches 50,51 or directly when its push button is pressed. The switches 50,52 may be mounted anywhere in the non-illustrated building, the limit switch 51 on one of the frames 1,2 to be struck by an abutment on the other frame and to open its circuit when the vent cover reaches its fully closed position.

The vent cover is normally held in the closed position by the rope 39 and the pulley 41 which is held stationary by the brake lever 45 under the force of the biasing spring 46. In the event of a fire, the link 47 is fused, the lever 45 is released, and the pulley 41 is free to rotate and to unwind the rope 39, thereby permitting the springs 14,14′ to move the vent cover to the open position.

For manual opening of the vent, the push-button switch 52 is operated to energize the solenoid 48, and thereby to lift the brake lever 45 from the pulley 41. The cover may be stopped in any intermediate position by merely releasing the push button switch 52. To close the window, the switch 50 is closed, whereby the brake lever 45 is released, and the torque of the motor 44 is transmitted to the pulley 41 by the energized clutch 43. When the cover reaches its fully closed position, the limit switch 51 stops the cover. It will be appreciated that the link 46 may need to be replaced before the window can be held in the closed position after the electrical devices are deenergized.

To protect the interior of the house against cold and draft, and to protect the operating devices of the automatic vent cover arrangement against atmospheric corrosion, the frames 1,2 are sealed to each other in the closed position of the cover. Angles 53,53′ depend from the movable, longitudinal frame members 5,5′ over the entire length of the latter, as is best seen in FIGS. 3, 4, 5 in such a manner that their flange portions overlap corresonding flange portions of the track members 3,3′ with as small a clearance as is consistent with the free translatory movement of the vent cover. An additional elongated angle 57 depends from the movable transverse frame member 56 for sealing cooperation with the flange portion of the stationary transverse frame member 13 in the closed cover position. For a practically airtight seal, a strip 54 of resilient material, such as closely spaced plastic bristles, is mounted on stationary frame member 13 for engagement with a rail 55 extending along the width of the movable frame 2 on the transverse frame member 56, as is shown in FIG. 6, but an analogous movable seal may also be provided elsewhere as desired.

The overlapping flanges of the angles 53,53′, 56 on the movable frame 2 and of the angles which form the stationary frame 1 cooperate also for preventing strong wind from moving the vent cover away from the roof. The brackets 8,8′, 11,11′ are abuttingly engaged in the fully open condition of the cover to limit the opening stroke of the cover in a manner evident from FIG. 5.

It should be understood, of course, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. A vent closure arrangement comprising a. two first track members elongated in a common direction in transversely spaced relationship and two transverse members interconnecting respective ends of the track members, the four members extending in a common plane and defining a vent opening therebetween, 1. the track members defining first roller tracks;

b. a unitary cover member of substantially the same dimensions as the vent opening mounted for translatory movement in a plane parallel to the common plane in the common direction between a closing position wherein the cover closes the vent opening and an open position wherein the cover permits access to the vent opening, the cover member comprising 1. two second track members elongated in the common direction in transversely spaced relationship, the second track members defining second roller tracks,
2. two transverse members interconnecting respective ends of the second track members, and
3. a translucent cover mounted on the four members;

c. first rollers affixed to the cover member and engaging the first roller tracks, and second rollers affixed to the first track members and engaging the second roller tracks, the rollers being arranged for rolling along the tracks they engage for said translatory movement;

d. biasing means for permanently biasing the cover member towards the open position;

e. detent means for retaining the cover member in the closing position against the force of the biasing means; and f. temperature responsive means for inactivating the detent means in response to a predetermined temperature, the temperature responsive means being mounted between the cover and the common plane.

2. The vent closure arrangement of claim 1, further comprising translatory movement limiting means cooperating to limit the movement of the cover member.

3. The vent closure arrangement of claim 1, further comprising cooperating flange means on the first and second track members for retaining the cover member on the first track members against substantial movement in a direction perpendicular to said planes.

4. The vent closure arrangement of claim 1, wherein, the biasing means comprises a spring member having one end attached to one of the members defining the vent opening, a first pulley attached to the other end of the spring member, a flexible elongated element having one end attached to one of the members of the cover member, and a guide pulley, the flexible element being trained over the pulleys and the other end of the elongated element being attached to the one member.

5. The vent closure arrangement of claim 1, wherein the detent means comprises a latch member mounted on one of the members defining the vent opening, a detent member mounted on the cover member and normally engaging the latch member, and the temperature responsive inactivating means includes an element moved by the inactivating means in response to the predetermined temperature to withdraw the detent member from engagement with the latch member whereby the cover member moves into the open position under the force of the biasing means.

6. The vent closure arrangement of claim 5, further comprising manually operable means for moving the cover member into the closing position wherein the detent member engages the latch member.

7. The vent closure arrangement of claim 1, wherein the detent means comprises a flexible elongated element having one end attached to the cover member, a pulley rotatably secured to one of the members defining the vent opening, the other end of the elongated element being wound on the pulley, and brake means for preventing rotation of the pulley whereby unwinding of the elongated element is prevented and the elongated element holds the cover member in the closed position, the temperature responsive inactivating means releasing the brake means in response to the predetermined temperature whereby the cover member moves into the open position under the force of the biasing means.

8. The vent closure arrangement of claim 7, further comprising electrically operated, manually controlled means for rotating the pulley in a direction to unwind the elongated element and simultaneously to release the brake means.

* * * * *